US006093881A

United States Patent [19]

Fay et al.

[11] Patent Number: 6,093,881

[45] Date of Patent: Jul. 25, 2000

[54] AUTOMATIC NOTE INVERSIONS IN SEQUENCES HAVING MELODIC RUNS

[75] Inventors: Todor C. Fay, Bellevue; Robert S. Williams, Seattle, both of Wash.

[73] Assignee: Microsoft Corporation, Redmond, Wash.

[21] Appl. No.: 09/243,193

[22] Filed: Feb. 2, 1999

[51] Int. Cl.[7] ..... G10H 5/00

[52] U.S. Cl. ..... 84/650; 84/613; 84/637

[58] Field of Search ..... 84/613, 637, 650–652, 84/669, DIG. 22

[56] References Cited

U.S. PATENT DOCUMENTS

| | | | |
|---|---|---|---|
| 4,526,078 | 7/1985 | Chadabe | 84/1.03 |
| 4,716,804 | 1/1988 | Chadabe | 84/1.03 |
| 5,052,267 | 10/1991 | Ino | 84/613 |
| 5,164,531 | 11/1992 | Imaizumi et al. | 84/634 |
| 5,179,241 | 1/1993 | Okuda et al. | 84/613 |
| 5,218,153 | 6/1993 | Minamitaka | 84/613 |
| 5,218,157 | 6/1993 | Akagawa et al. | 84/637 |
| 5,235,126 | 8/1993 | Bruti et al. | 84/618 |
| 5,278,348 | 1/1994 | Eitaki et al. | 84/636 |
| 5,281,754 | 1/1994 | Farrett et al. | 84/609 |
| 5,286,908 | 2/1994 | Jungleib | 81/603 |
| 5,315,057 | 5/1994 | Land et al. | 84/601 |
| 5,355,762 | 10/1994 | Tabata | 84/609 |
| 5,455,378 | 10/1995 | Paulson et al. | 84/610 |
| 5,496,962 | 3/1996 | Meier et al. | 84/601 |
| 5,753,843 | 5/1998 | Fay | 84/609 |
| 5,777,254 | 7/1998 | Fay et al. | 84/613 |

*Primary Examiner*—Jeffrey Donels
*Attorney, Agent, or Firm*—Lee & Hayes, PLLC

[57] ABSTRACT

A method of generating music includes steps of specifying a note sequence and a chord progression against which the note sequence is played. The notes of the note sequence are defined relative to chord elements, and melodic runs are identified within the note sequence. Each melodic run consists of a series of notes. Inversion conditions are specified in terms of inversion boundaries and in terms of legal inversion notes relative to the individual chords of the chord progression. When interpreting the note sequence in conjunction with the chord progression to generate output notes, the output notes are compared against the inversion conditions and inverted if appropriate. If a note belongs to an identified melodic run, the run is evaluated against the inversion conditions as a whole. More specifically, one note of the melodic run is compared against the inversion conditions. If the one note satisfies the inversion conditions, the entire run is inverted. If the one note does not satisfy the inversion conditions, none of the notes of the run are inverted.

26 Claims, 7 Drawing Sheets

AUTOMATIC NOTE INVERSIONS IN SEQUENCES HAVING MELODIC RUNS

TECHNICAL FIELD

The present invention relates to computer-based musical performance devices. In particular, the invention relates to methods of inverting automatically-generated notes during a computer-generated musical performance created by a computer.

BACKGROUND OF THE INVENTION

Context-sensitive musical performances have become key components of electronic and multimedia products such as stand-alone video games, computer based video games, computer based slide show presentations, computer animation, and other similar products and applications. As a result, music generating devices and/or music playback devices have been more highly integrated into electronic and multimedia products. Previously, musical accompaniment for multimedia products was provided in the form of pre-recorded music that could be retrieved and performed under various circumstances.

Using pre-recorded music for providing context-sensitive musical performances has several disadvantages. One disadvantage is that the pre-recorded music requires a substantial amount of memory storage. Another disadvantage is that the variety of music that can be provided using this approach is limited by the amount of available memory. The musical accompaniment for multimedia devices utilizing this approach is wasteful of memory resources and can be very repetitious.

Today, music generating devices are directly integrated into electronic and multimedia products for composing and providing context-sensitive, musical performances. These musical performances can be dynamically generated in response to various input parameters, real-time events, and conditions. For instance, in a graphically based adventure game, the background music can change from a happy, upbeat sound to a dark, eerie sound in response to a user entering into a cave, a basement, or some other generally mystical area. Thus, a user can experience the sensation of live musical accompaniment as he engages in a multimedia experience.

One way of accomplishing this is to define musical performances as combinations of chord progressions and note sequences, so that notes are calculated during a performance as a function of both a chord progression and a note sequence. A chord progression defines a time sequence of chords. An individual chord is defined as a plurality of notes, relative to an absolute music scale. A note sequence defines a time sequence of individual notes. The notes of a note sequence, however, are not defined in terms of the absolute music scale. Specifically, the notes are defined by their positions within chords, rather than by their absolute positions on a musical scale or keyboard. As a simple example, a note might be defined as the second note of a chord. This note would then vary, depending on which chord with which the note is played. The second note of a C chord is E, so an E is played when the note is interpreted in conjunction with a C chord. The second note of a G chord is B, so a B is played when the note is interpreted in conjunction with a G chord. Interpreting a chord in this manner is referred to as playing the note "against" a specified chord. The result of this is that the notes of a musical track are transposed or mapped to different pitches when played against different chords.

To generate actual output notes based on a chord progression and a note sequence, the notes of the note sequence are played against the chords of the chord progression. The chords of the progression have associated timing, so that any given note from the note sequence is matched with a particular chord of the progression. When the note is played, it is played against the current chord of the progression. This scheme allows a musical performance to be varied in subtle ways, by changing either the chord progression or the note sequence as the performance progresses.

Thus, one of the functions of a computer-based music performance engine is to derive a note sequence based on a note sequence and the chords of an underlying chord progression. Depending on the particular chords of the progression, a particular note generated from a note sequence might vary by a significant amount. In some cases, an output note may be transposed to a pitch that is outside of a desired range of pitch or the range of an instrument.

To prevent notes from being transposed beyond permissible or desirable ranges, the performance engine automatically inverts notes to keep them within a specified range. Inversion involves transposing a note up or down one or more octaves, thereby forcing the note to fall within a specified range of pitch.

Previous systems have used an upper-pitch and lower-pitch boundary to define a desired range of pitch. In these systems, each musical track (a track usually corresponds to a specific instrument or musical part) specified its own fixed inversion boundaries. The boundaries were specified in terms of MIDI (musical instrument digital interface) note values. When playing a note against a chord resulted in the note falling outside the one of the boundaries, the note was inverted by an appropriate number of octaves to bring it back within the boundaries.

Although previous inversion techniques were able to force a note sequence within a specified pitch range, this often had undesirable side effects. Specifically, the inversion of a note sometimes broke up a melodic run or line. A melodic run is a sequence of notes written with a specific harmonic relationship. Inverting individual notes within such a run can drastically alter the sound of the run, often causing it to lose its desired effect.

Another undesirable side effect of previous techniques was that inversion often changed the voicing of a specified chord. Again, this often produced an unacceptable change in the nature of the music.

Accordingly, there is a need for an improvement in the way automatic inversion is performed in systems such as the one described above.

SUMMARY OF THE INVENTION

In accordance with the invention, melodic runs are identified within a note sequence. Each note specification within the note sequence includes a group value. A group value of zero indicates that the note is not part of a run. Any other value indicates the particular run to which the note belongs.

When a performance engine encounters the first note of a run, the performance evaluates that note against predefined inversion conditions. If the note meets the inversion conditions, the note and all other members of the same run are inverted by the same amount. If the note does not meet the inversion conditions, no notes of the run are inverted.

The predefined inversion conditions consist of upper and lower inversion boundaries, specified for each track. In addition, each chord of a chord progression specifies an inversion mask. The inversion mask indicates legal inversion notes relative to a chord. A note is considered to meet the inversion conditions if both (a) the note is outside of the inversion boundaries and (b) there is a legal inversion note between the inversion boundaries and the note.

DETAILED DESCRIPTION

Computing Environment

Figure 1:
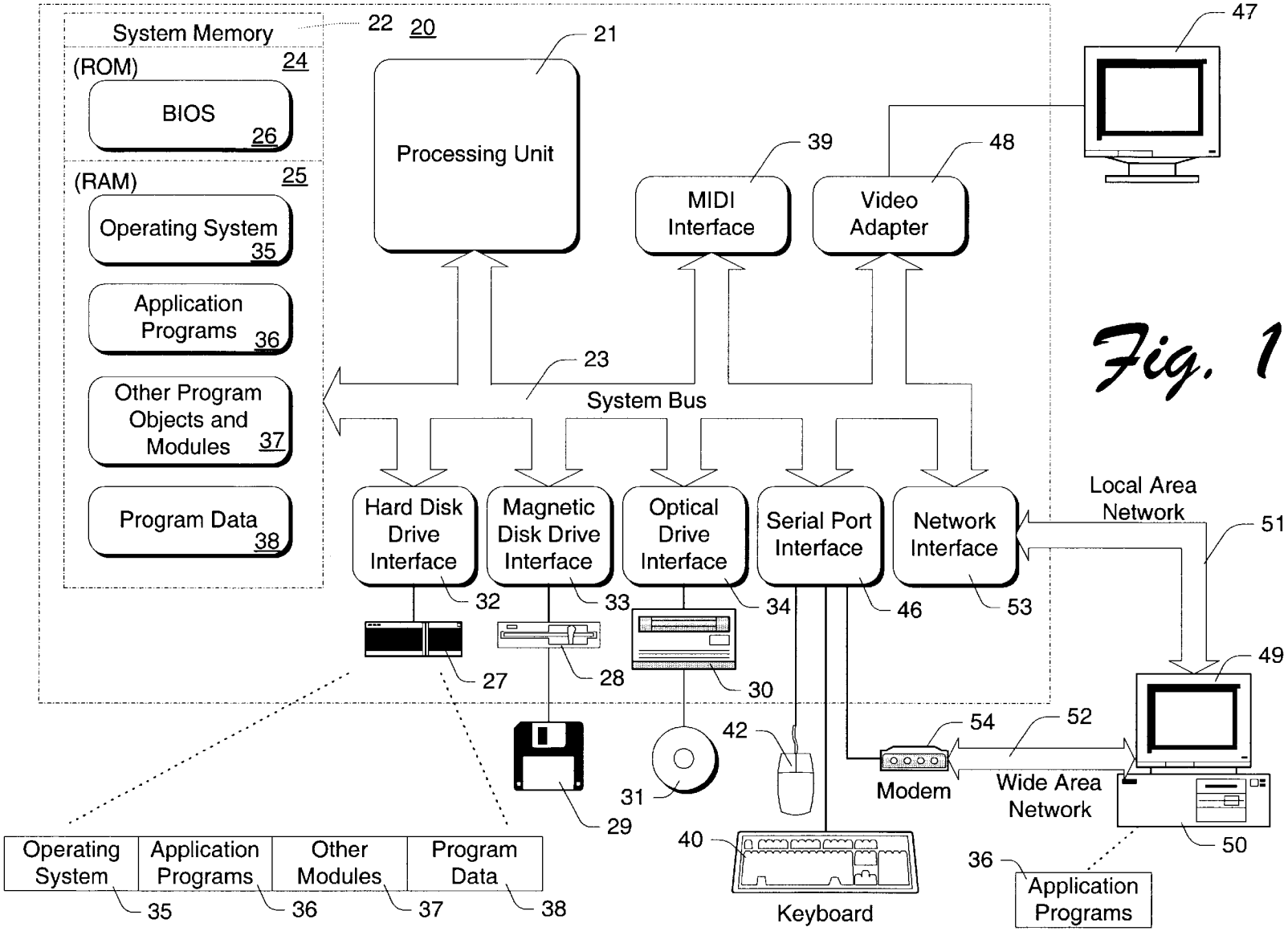
FIG. 1 is a system diagram that illustrates an exemplary environment suitable for implementing embodiments of the present invention.

FIG. 1 and the related discussion give a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

Computer 20 includes a musical instrument digital interface ("MIDI") component 39 that provides a means for the computer to generate music in response to MIDI-formatted data. In many computers, such a MIDI component is implemented in a "sound card," which is an electronic circuit installed as an expansion board in the computer. The MIDI component responds to MIDI events by rendering appropriate tones through the speakers of the computer.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 1. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as the "Windows" family of operating systems available from Microsoft Corporation. An operating system of this type can be configured to run on computers having various different hardware configurations, by providing appropriate software drivers for different hardware components. The functionality described below is implemented using standard programming techniques, including the use of OLE (object linking and embedding) and COM (component object interface) interfaces such as described in Rogerson, Dale; *Inside COM*, Microsoft Press, 1997. Familiarity with object-based programming, and with COM objects in particular, is assumed throughout this disclosure.

Inversion of Melodic Runs

Figure 2:
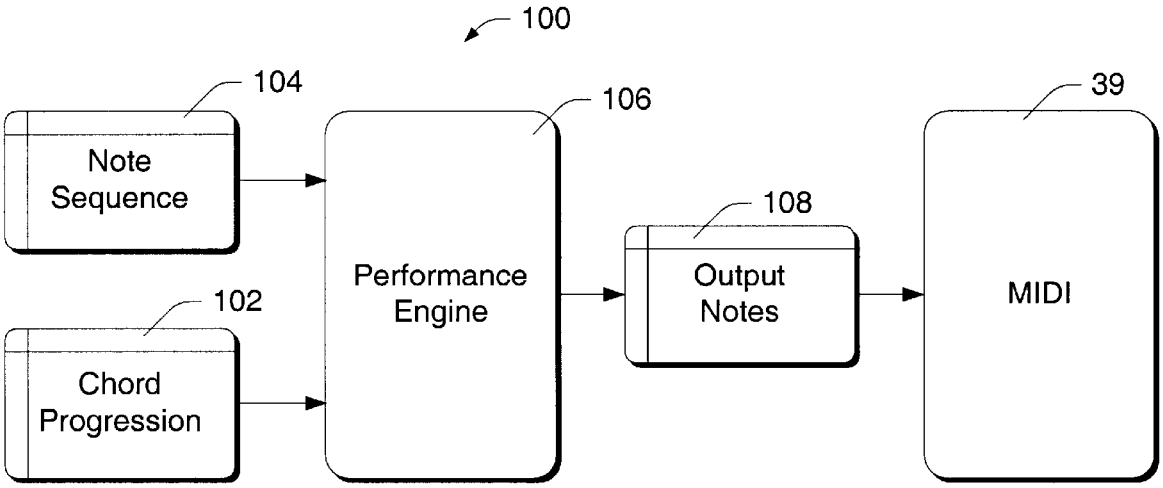
FIG. 2 is a block diagram illustrating a general architecture of a musical generating system.

FIG. 2 shows a system, implemented by the computer described above, for rendering music based on a chord progression 102 and a note sequence 104. The chord progression and note sequence can be provided in different forms. For example, they might originate from static, disk-based files. Alternatively, they might be provided as data streams from other program components, composed in real-time in response to the real-time stimuli such as operator input or changing game conditions.

A performance engine 106 receives the chord progression 102 and the note sequence 104 and in response generates an output note sequence 108. The output note sequence is generated as described above by playing the note sequence against the chord progression. More details regarding this procedure are set forth U.S. Pat. Nos. 5,753,843 and 5,777,254.

In the described embodiment, the output note sequence is formatted as a MIDI stream, and is provided to a MIDI controller or interface 39. The MIDI controller or interface interprets the MIDI stream and in response generates appropriate musical tones on the speakers of computer 20. Alternatively, the MIDI controller o r interface 39 might communicate the MIDI st ream to an external MIDI device (such as a keyboard or synthesizer) for rendering by the external MIDI device.

As described above, output notes 108 are determined based on both chord progression 102 and note sequence 104, each of which might have been composed independently. As a result, the output notes can vary widely, often falling above or below a desired range of output notes. To prevent this, performance engine 106 performs automatic inversion of the output notes to keep them within the desired range.

However, performance engine 106 is configured to protect melodic runs from being broken. To accomplish this, note sequence 104 includes information that allows performance engine 106 to identify melodic runs within note sequence 104. Up on identifying a group of notes within note sequence 104 that form a melodic run, performance engine 106 inverts the resulting output notes as a group, rather than individually. Thus, either all output notes of the group are inverted, or none of the notes of the group are inverted.

In the described embodiment of the invention, the decision of whether to invert the notes of a melodic run is made based upon the first-occurring note of the melodic run. This first note of the run is evaluated to determine whether it meets pre-defined conditions for inversion. For example, the first output note of an identified group might be compared against upper and lower inversion boundaries to see of the output note falls outside of those boundaries. If it does, all output notes of the group are inverted by the same number of octaves.

Figure 3:
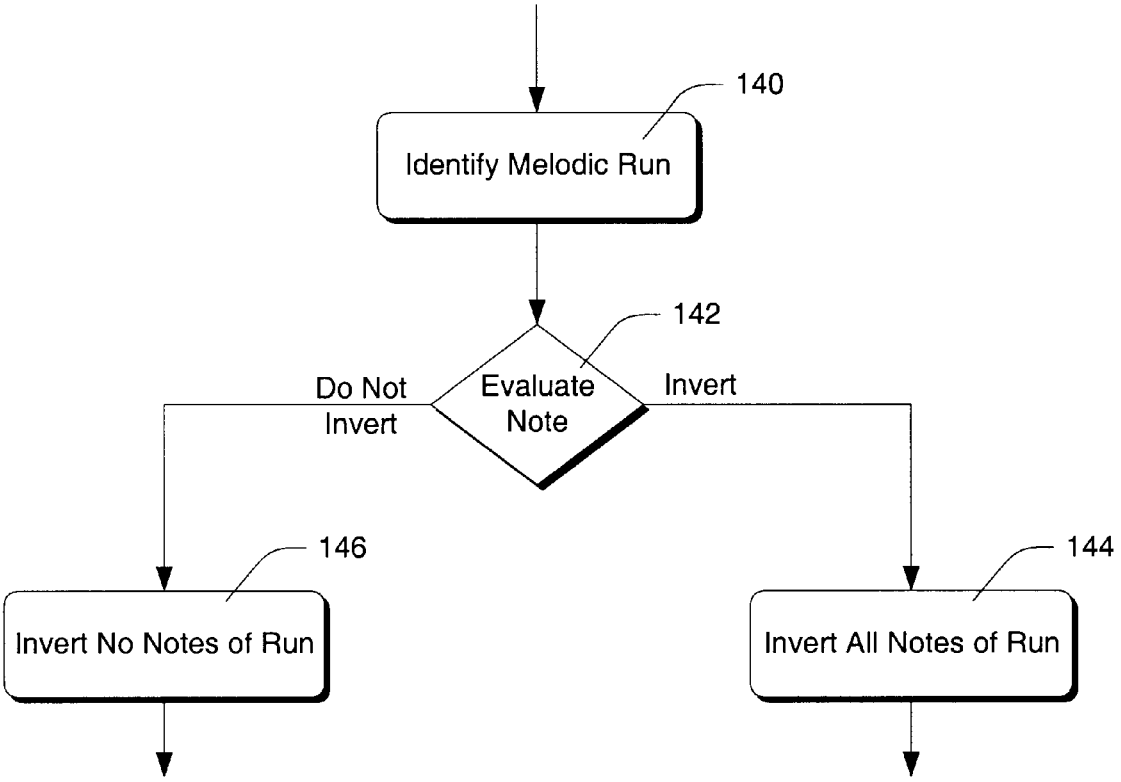
FIG. 3 is a flowchart illustrating general inversion steps in accordance with the invention.

FIG. 3 shows steps performed in accordance with the invention when rendering notes such as those from a note sequence. A step 140 comprises identifying a group of notes that form a melodic run within the note sequence. In the described embodiment, melodic runs are flagged by the composer of the note sequence so that the runs can be easily identified by performance engine 106. A step 142 comprises determining whether at least one of the output notes meets pre-defined conditions for inversion. A step 144, performed if at least one of the notes of the group meets the predefined conditions for inversion, comprises inverting all of the output notes of the group. If the test of step 142 is not satisfied, none of the notes of the group are inverted, as indicated by block 146.

Step 142 evaluates at least one of the output notes generated from the note sequence. As already mentioned, in the described embodiment of the invention this involves only the first-occurring output note. In other embodiments, however, step 142 might evaluate different notes of the group. For example, the note evaluated against the predefined conditions for inversion might be the first note of the group, the last note, the note having the highest pitch, or the note having the lowest pitch. Furthermore, step 142 might evaluate a plurality of the output notes against the predefined conditions for inversion. For example, inversion might be performed only if all of the output notes meet the predefined conditions for allowance.

Conditions for Inversion

Step 142 evaluates one or more notes against defined conditions that indicate whether inversion is appropriate. In the specific environment described herein, these conditions are defined by (a) upper and lower inversion boundaries for each track of a musical piece; and (b) legal inversion notes relative to each chord in a chord progression.

The upper and lower inversion boundaries indicate notes surrounding a desired note range for a particular music track.

A music track is understood in this environment to be a sequence of notes that are destined to a particular instrument or group of instruments. Generally, a musical piece comprises a plurality of tracks that are played concurrently. The inversion boundaries are specified along with other track information, in terms of an absolute music scale such as defined by the MIDI standard.

Legal inversion notes for each chord of a chord progression are defined by indicating such notes within the data structures that define the chord or by providing additional information with the chord. In addition, if the chord progression contains a polychord composed of multiple chords, each chord in the polychord can include inversion information.

The data structure in an exemplary embodiment represents each chord by including four fields: chord definition, scale definition, chord inversion mask, and root note. The first three fields are 24-bit fields with each bit representing a consecutive note in a two octave range and with each octave including 12 semitone steps. In the chord definition field, each bit in the 24-bit field is set if the note corresponding with the bit is a member of the chord. In the scale definition field, each bit in the 24-bit field is set if the note corresponding with the bit is a member of the scale, against which the chord is defined. The chord inversion mask is used to identify notes at which inversions are allowed. Thus, in an exemplary embodiment, setting a bit in the 24-bit field indicates that inversions are allowed at that note. The root note field establishes an offset from lowest note for the chord, scale, and chord inversion mask fields. Thus, the two octave range represented by the chord, scale, and chord inversion mask fields is based on the root note field.

Figure 4:
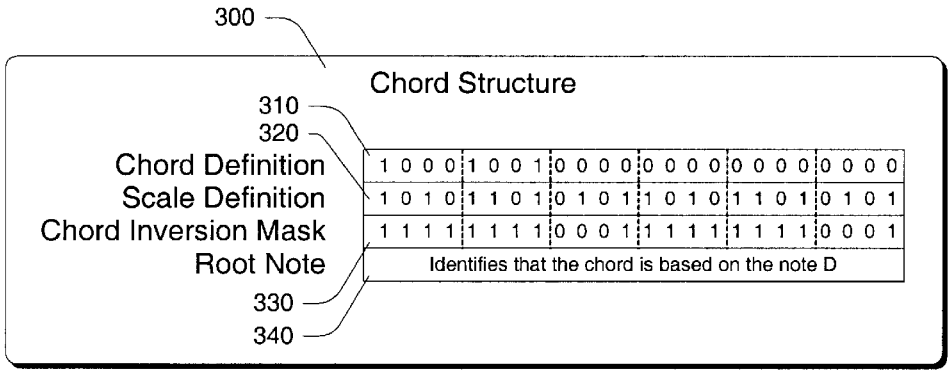
FIG. 4 is a block diagram of a chord structure.

FIG. 4 is a block diagram illustrating an example of the data structure for a chord in the exemplary embodiment. The chord structure 300 includes a chord definition 310, a scale definition 320, a chord inversion mask 330, and a root note 340. The chord definition 310, scale definition 320, and chord inversion mask 330 are illustrated as 24-bit fields with a dashed line being drawn between each 4-bit nibble. The left-most bit of each 24-bit field represents the lowest pitch in the range of that field. The chord definition 310 illustrates the notes of a C triad chord. The scale definition 320 identifies a major scale. The root note 340 indicates that the chord is based on the note D. The chord inversion mask indicates that inversions are allowed except between the 5th and 7th of the chord.

Figure 5:
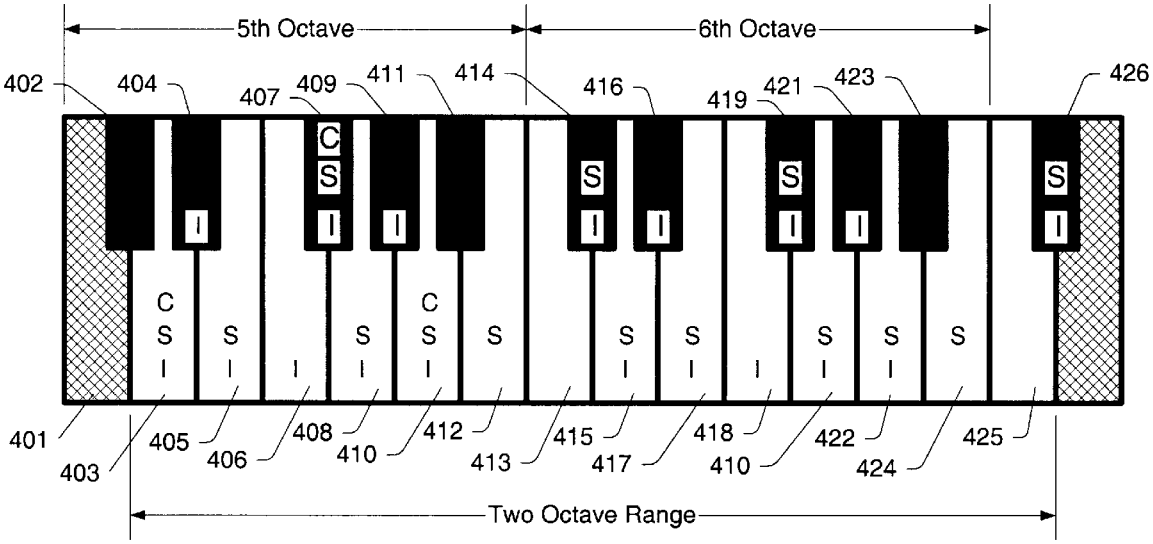
FIG. 5 is a diagram of a portion of a keyboard, indicating the chord specified by the structure of FIG. 4.

FIG. 5 is a diagram of the pertinent portion of a keyboard relative to the example chord structure 300 in FIG. 4. The keyboard keys 401–412 represent the notes of the 5th octave and the keyboard keys 413–424 represent the notes of the 6th octave. Key 403 corresponds with the D note in the 5th octave (i.e., root note 340 of FIG. 4). When the chord definition 310 is offset by the root note 340, the notes correspond with keyboard keys 403, 407, and 410. These keys are further identified in FIG. 5 by the character 'C'. Similarly, the scale definition 320 offset by the root note 340 correspond with the keyboard keys 403, 405, 407, 408, 410, 412, 414, 415, 417, 419, 420, 422, 424, and 426. These keys are further identified in FIG. 5 by the character 'S'. Finally, the chord inversion mask 330 offset by the root note 340 corresponds with the keyboard keys 403, 404, 405, 406, 407, 408, 409, 410, 414, 415, 416, 417, 418, 419, 420, 421, 422, and 426. These keys are further identified in FIG. 4 by the character 'I'.

Given this method of specifying legal inversion notes relative to a chord, a note meets conditions for inversion if (a) the note is outside the no-inversion range specified by the upper and lower inversion boundaries of a track; and (b) there exists a legal inversion note (specified in the current chord structure) between the note and the no-inversion range.

The chord inversion mask provides additional control and flexibility in identifing locations to allow note inversons. If all 24-bits of the chord inversion mask are set, then the chord inversion mask does not restrict note inversions. However, if it is desirable to prevent particular notes from being inverted, the corresponding bits in the chord inversion mask are cleared.

Methodological Aspects

Figure 6:
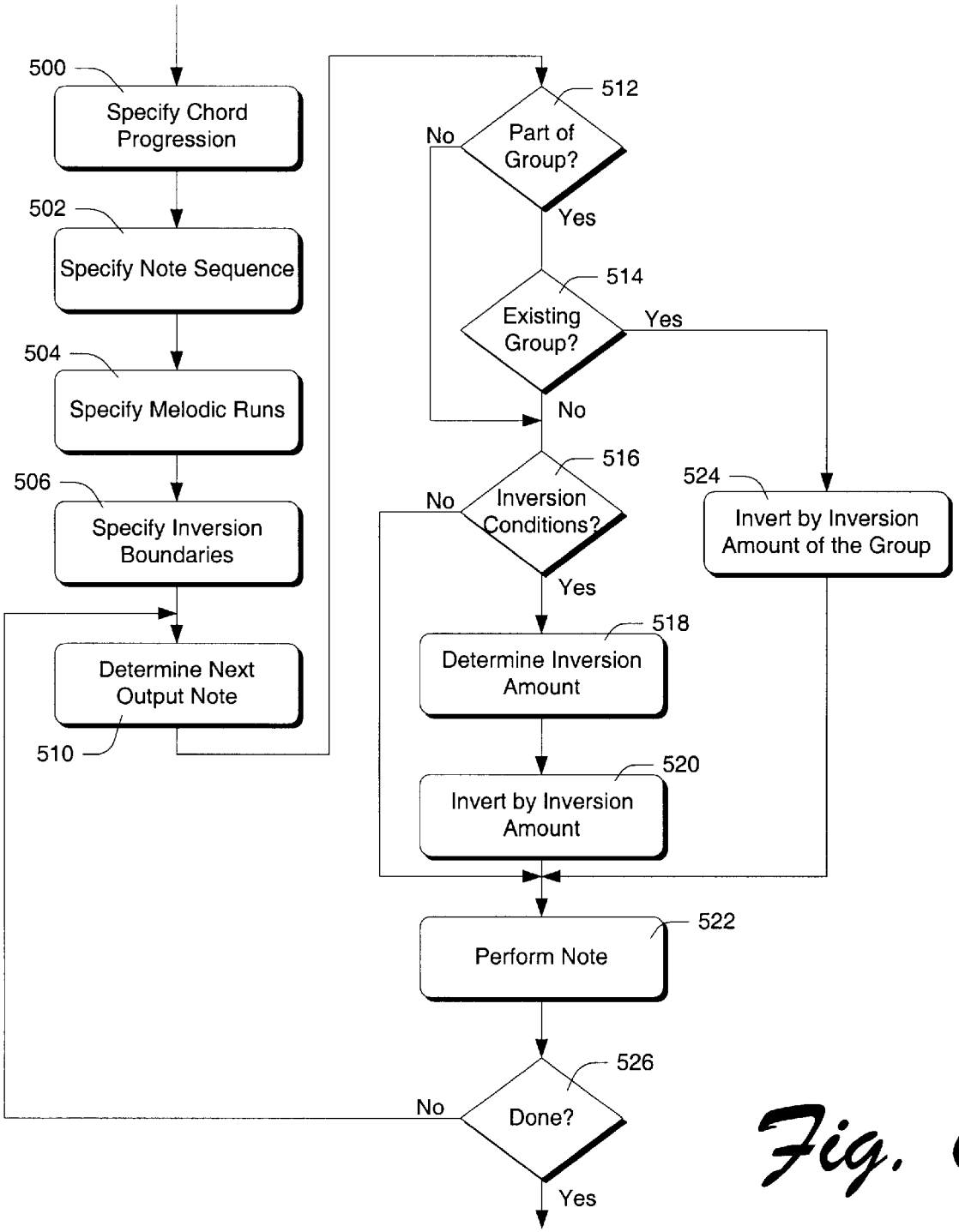
FIG. 6 is a flowchart illustrating methodological aspects of the invention.

FIG. 6 illustrates exemplary steps in accordance with the invention for determining and rendering output notes based on a chord progression and a note sequence. A step 500 comprises specifying a chord progression. The chords of the chord progression are specified as described above. Accordingly, this step includes specifying legal inversion notes for each chord of a progression.

A step 502 comprises specifying a note sequence. Each note in a note sequence is specified relative to the chords of the chord progression. As described above, each chord is defined by a chord structure that includes note of the chord and notes of an underlying scale. A note in the note sequence is specified by four items (relative to the current chord and chord scale of the chord progression): a chord position, indicating an absolute keyboard position at which the chord of the chord progression will be considered to reside; a note within the chord (such as the $n^{th}$ note of the chord); an offset along the chord scale from the specified note of the chord; and an additional absolute offset to allow for accidentals. At rendering time, these four items are evaluated against the current chord structure to produce an output note.

Step 504 comprises specifying or identifying one or more melodic runs within the note sequence. In the described embodiment, each note specification includes a group value that indicates whether the note belongs to a melodic run. If the note is part of a melodic run, the value identifies the particular melodic run to which the note belongs. A group value of zero indicates that the note does not form part of a melodic group. Any other group value indicates a particular melodic run. Any notes having the same non-zero group value are considered part of the same melodic run. The performance engine examines the group values to determine whether individual notes are members of groups.

A step 506 comprises specifying or identifying upper and lower inversion boundaries for the track with which the chord progression and note sequence are associated. These boundaries are preferably stored with track information. Any note below the lower inversion boundary or above the upper inversion boundary is a candidate for inversion. Thus, the inversion boundaries specify a no-inversion range—a range of notes that will not be considered for inversion unless they form part of a melodic run that otherwise qualifies for inversion.

A step 510 comprises receiving or reading the next note specification in the note sequence, and inter there against the current chord structure to determine an output note. In the described embodiment, the output note is represented as a MIDI note structure. The following steps are applied to the output note resulting from this step.

Subsequent step 512 comprises determining whether the output note is a member of a melodic run (referred to as a group in FIG. 6). If so, a step 514 is performed of determining whether the note is a member of a run or group that has already been encountered—whether the group value is the same as the group value of a previous note. Assuming that the note is part of a new group that has not yet been analyzed, execution proceeds to step 516. If the result of step 512 is negative (the note is not part of a group), step 514 is skipped and execution proceeds with step 516.

Step 516 comprises determining whether the current note meets the predefined conditions for inversion. Specifically, this step comprises determining whether the note is outside of the no-inversion range specified by the upper and lower inversion boundaries and whether there is a legal inversion note (defined in the current chord of the chord progression) between the upper and lower inversion boundaries and the current note.

If the inversion condition s are not met in step 516, step 522 is performed of performing the note (in this case without any inversion). If the inversion conditions ore met in step 516, a step 518 is performed of determining the appropriate inversion amount for the note. The inversion amount will be a number of half steps that is an integer multiple of twelve—one or more octaves. The note is inverted by an amount that will result in the output note falling within the specified inversion boundaries. If the note is part of a group, the inversion amount will be recorded for future use with other notes of this same group.

Step 522 comprises performing the note, which has potentially been inverted by the previous steps.

Referring again to step 514, if the current note is part of an existing melodic run (as indicated by a group value that is identical to the group value of a previous note), a step 524 is performed of inverting the note by the inversion amount previously calculated in step 518 for the melodic run. Thus, only the first note of a melodic run is analyzed against the inversion conditions. Subsequent notes of a run are inverted by the same amount as the first note. If the first note of the group did not meet the conditions for allowance, the inversion amount is specified as zero for the group, and none of the notes of the group are inverted.

After step 524, execution proceeds to step 522 of performing the note.

Step 526 comprises determining whether there are any remaining notes in the note sequence. If there are, execution returns to step 510, and the next note is analyzed.

Figure 7:
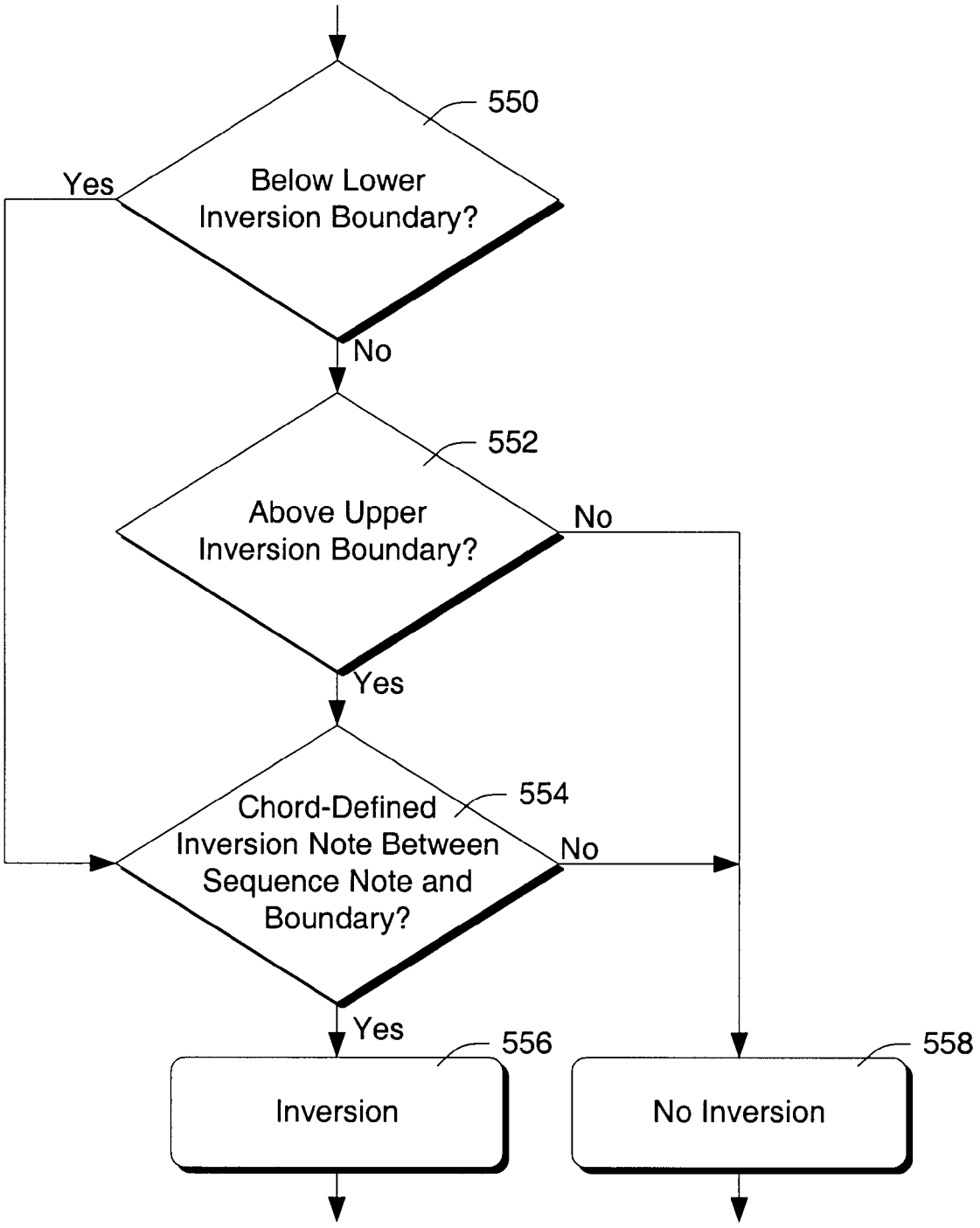
FIG. 7 is a flowchart illustrating the evaluation of inversion conditions in accordance with the invention.

FIG. 7 illustrates step s performed with respect to a single note when evaluating the inversion conditions. A step 550 comprises determining whether the note is below the lower inversion boundary. If it is not, a step 552 is performed of determining whether the note above the upper inversion boundary. If either of steps 550 or 552 is true, step 554 is performed if determining whether there is a legal inversion note defined by the current chord of the chord progression, between the current note and the inversion boundaries. If the current note is above the upper inversion boundary, this step determines whether there is a legal inversion note defined between the upper inversion boundary and the current note. If the current note is below the lower inversion boundary, this step determines whether there is a legal inversion note defined between the lower inversion boundary and the current note. If step 554 evaluates true, step 556 is performed of inverting the note (or the associated group of notes). If any of steps 550, 552, or 554 evaluates false, step 558 is performed, indicating that no inversion is performed on the note (or the associated group of notes).

Example

Figure 8:
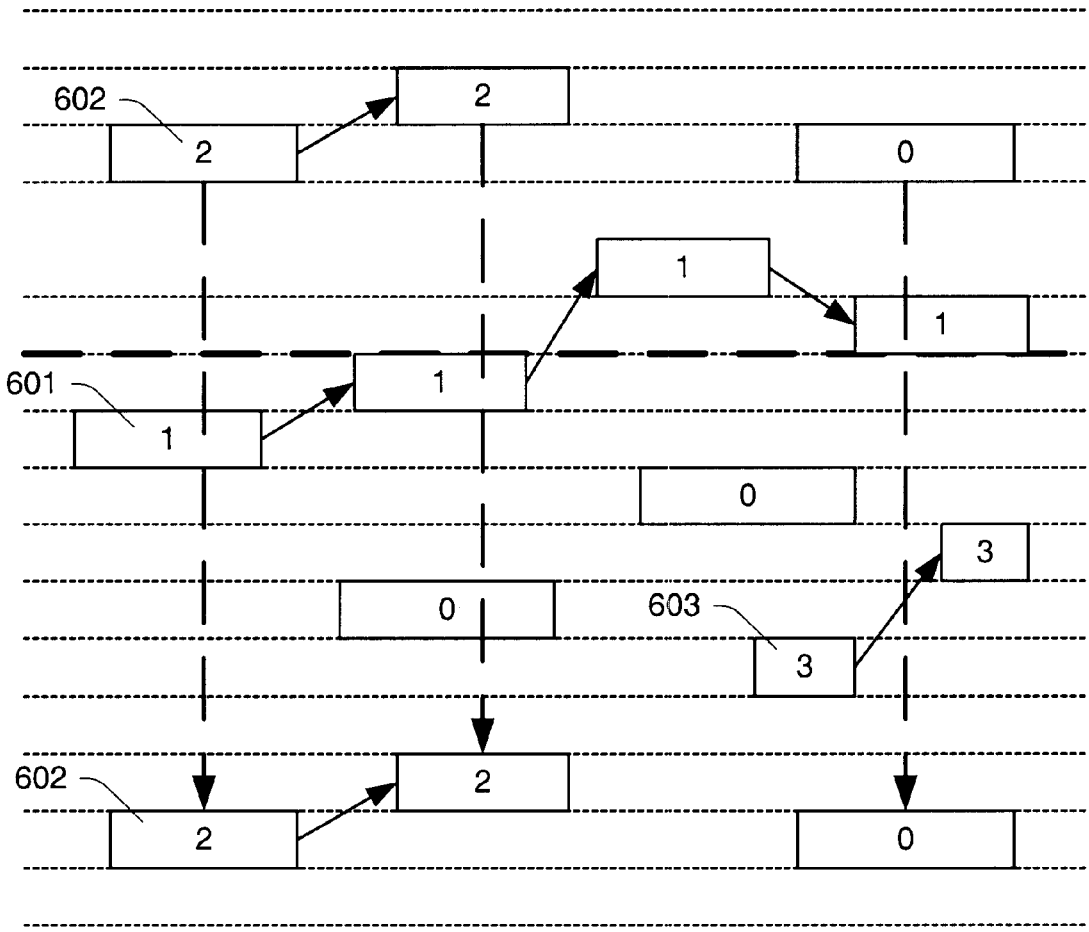
FIG. 8 is a block diagram illustrating inversion of melodic runs in accordance with the invention.

FIG. 8 illustrates the effect of the inversion techniques described above with respect to specific melodic runs. FIG. 8 illustrates a portion of a note sequence. Individual notes are represented as rectangles in a timeline. Time is indicated as proceeding from left to right. Pitch is indicated by vertical position in the timeline, with higher notes being shown higher in the timeline. Dashed horizontal lines indicate note positions within the vertical scale of the timeline. An upper inversion boundary is shown as a bold dashed line.

Some of the notes in FIG. 8 are to be inverted. For these notes, a dashed downward arrow indicates an inverted note (shown with diagonal hatching) that is to be substituted for the original note.

The notes of FIG. 8 form three groups or melodic runs. One melodic run, referenced by numeral 601, has a group value of 1 (the group value of each note is indicated within the rectangle representing the note). The note sequence also includes runs 602 and 603, having group values 2 and 3, respectively. Three of the notes have a group value of 0, indicating that they do not belong to any melodic run.

For simplicity and clarity, the example assumes that the inversion conditions do not include any evaluation of chord-defined inversion notes. Rather, the decision of whether a particular note meets the inversion conditions is made solely with reference to the upper inversion boundary.

Run 601 has four notes. The first note, however, is below the inversion boundary. Accordingly, none of the notes of this run are inverted, even through the last two notes of the run are above the inversion boundary.

Run 602 has two notes, both of which are above the inversion boundary. Since the first note of this run is above the inversion boundary, every note of the run is inverted by the same amount.

Run 603 has two notes, both of which are below the inversion boundary. No inversion is performed on these notes.

The remaining notes are not part of any run. Accordingly, they are evaluated individually to determine whether they meet the inversion conditions. In the example, only one of the notes is above the inversion boundary, and only that note is inverted.

Conclusion

The invention provides a significant improvement in the way inversions are performed in computer-generated music. Specifically, the invention preserves the intended effect of melodic runs and thereby enhances the music performance as a whole.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of processing music notes, comprising the following steps:

identifying a group of notes that form a melodic run;

determining whether at least one of the notes meets pre-defined conditions for inversion;

inverting all of the notes of the group if said at least one of the notes meets the predefined conditions for inversion.

2. A method as recited in claim 1, wherein said at least one of the notes is the first-occurring note of the group of notes.

3. A method as recited in claim 1, wherein said at least one of the notes is the highest-pitched note of the group.

4. A method as recited in claim 1, wherein said at least one of the notes is the lowest-pitched note of the group.

5. A method as recited in claim 1, wherein said at least one of the notes includes a plurality of the notes.

6. A method as recited in claim 1, wherein said at least one of the notes includes all of the notes of the group.

7. A method as recited in claim 1, wherein the step of determining whether at least one of the notes meets pre-defined conditions for inversion comprises:

determining whether said at least one of the notes is outside of a predefined range of notes.

8. A method as recited in claim 1, wherein the step of determining whether at least one of the notes meets pre-defined conditions for inversion comprises:

determining whether there is a predefined inversion note between said predefined range of notes and said at least one of the notes.

9. A method as recited in claim 1, wherein the step of determining whether at least one of the notes meets pre-defined conditions for inversion comprises:

determining whether said at least one of the notes is outside of a predefined range of notes; and determining whether there is a predefined inversion note between said predefined range of notes and said at least one of the notes.

10. A computer that is programmed to perform steps comprising:

specifying a note sequence, wherein the notes of the sequence are defined relative to chord elements;

identifying one or more melodic runs within the note sequence, each melodic run comprising a plurality of the notes of the note sequence;

specifying upper and lower inversion boundaries for the note sequence;

specifying a progression of chords;

specifying inversion notes relative to the chords of the progression;

interpreting the note sequence in conjunction with the progression of chords to generate output notes;

determining whether at least one of the output notes generated from a particular melodic run meets pre-defined conditions for inversion;

inverting all of the output notes generated from the particular melodic run if said at least one of the output notes meets the pre-defined conditions for inversion.

11. A computer as recited in claim 10, wherein the determining step comprises:

determining whether there is an inversion note specified between the inversion boundaries and said at least one of the output notes.

12. A computer as recited in claim 10, wherein the determining step comprises:

determining whether said at least one of the output notes is outside of the inversion boundaries.

13. A computer as recited in claim 10, wherein the determining step comprises:

determining whether said at least one of the output notes is outside of the inversion boundaries;

determining whether there is an inversion note specified between the inversion boundaries and said at least one of the output notes.

14. A computer as recited in claim 10, wherein the step of specifying inversion notes comprises specifying inversion notes for each chord of the chord progression.

15. A computer as recited in claim 10, wherein said at least one of the notes is the first-occurring note of the group of notes.

16. A computer as recited in claim 10, wherein said at least one of the notes is the highest-pitched note of the group.

17. A computer as recited in claim 10, wherein said at least one of the notes is the lowest-pitched note of the group.

18. A computer as recited in claim 10, wherein said at least one of the notes includes a plurality of the notes.

19. A computer as recited in claim 10, wherein said at least one of the notes includes all of the notes of the group.

20. A computer program stored on one or more computer-readable storage media for generating music, the program comprising the following steps:

specifying a note sequence, wherein the notes of the sequence are defined relative to chord elements;

identifying one or more melodic runs within the note sequence, each melodic run comprising a plurality of the notes of the note sequence;

specifying upper and lower inversion boundaries for the note sequence;

specifying a progression of chords;

specifying inversion notes relative to the chords of the progression;

interpreting the note sequence in conjunction with the progression of chords to generate output notes;

determining whether at least one of the output notes generated from a particular melodic run is outside of the inversion boundaries;

determining whether there is an inversion note specified between the inversion boundaries and said at least one of the output notes;

inverting all of the output notes generated from the particular melodic run if said at least one of the output notes is outside of the inversion boundaries and if there is an inversion note specified between the inversion boundaries and said at least one of the output notes.

21. A computer program as recited in claim 20, wherein the step of specifying inversion notes comprises specifying inversion notes for each chord of the chord progression.

22. A method as recited in claim 20, wherein said at least one of the notes is the first-occurring note of the group of notes.

23. A method as recited in claim 20, wherein said at least one of the notes is the highest-pitched note of the group.

24. A method as recited in claim 20, wherein said at least one of the notes is the lowest-pitched note of the group.

25. A method as recited in claim 20, wherein said at least one of the notes includes a plurality of the notes.

26. A method as recited in claim 20, wherein said at least one of the notes includes all of the notes of the group.

* * * * *

UNITED STATES PATENT AND TRADEMARK OFFICE

CERTIFICATE OF CORRECTION

PATENT NO. : 6,093,881
DATED : July 25, 2000
INVENTOR(S) : Todor C. Fay, et al.

It is certified that error appears in the above-identified patent and that said Letters Patent is hereby corrected as shown below:

Column 8,
Line 6, change "identifing" to -- identifying --.
Line 57, change "inter there" to -- interpreting the note --.

Column 9,
Line 13, change "condition s" to -- conditions --.
Line 15, change "ore" to -- are --.
Line 42, change "step s" to -- steps --.

Signed and Sealed this

Second Day of October, 2001

*Attest:*

Nicholas P. Godici

*Attesting Officer*

NICHOLAS P. GODICI
*Acting Director of the United States Patent and Trademark Office*